US010190831B2

(12) United States Patent
Yao et al.

(10) Patent No.: US 10,190,831 B2
(45) Date of Patent: Jan. 29, 2019

(54) RADIATING FIN WITH BENT RADIATING PORTION AND ELECTROTHERMAL OIL HEATER USING SAME

(71) Applicant: Ningbo Singfun Electric Appliance Co., Ltd., Zhejiang (CN)

(72) Inventors: Guoning Yao, Zhejiang (CN); Jialei Mao, Zhejiang (CN)

(73) Assignee: Ningbo Singfun Electric Appliance Co., Ltd., Zhejiang (CN)

( * ) Notice: Subject to any disclaimer, the term of this patent is extended or adjusted under 35 U.S.C. 154(b) by 305 days.

(21) Appl. No.: 14/970,249

(22) Filed: Dec. 15, 2015

(65) Prior Publication Data

US 2016/0187073 A1 Jun. 30, 2016

(30) Foreign Application Priority Data

Dec. 31, 2014 (CN) ..... 2014 1 0855616

(51) Int. Cl.
*F24H 3/00* (2006.01)
*F28F 3/06* (2006.01)
(Continued)

(52) U.S. Cl.
CPC ..... *F28F 3/06* (2013.01); *F24H 3/004* (2013.01); *F28D 1/0333* (2013.01);
(Continued)

(58) Field of Classification Search
USPC ..... 165/6–9, 281–302
See application file for complete search history.

(56) References Cited

U.S. PATENT DOCUMENTS 4,002,201 A * 1/1977 Donaldson ..... F28D 1/0333 165/140
4,011,905 A * 3/1977 Millard ..... F28D 1/0333 123/41.27

(Continued)

FOREIGN PATENT DOCUMENTS

CN 200920141585.3 1/2010
EP 0251973 * 7/1988
JP 01112635 A * 5/1989

*Primary Examiner* — Ibrahime A Abraham
*Assistant Examiner* — Gyounghyun Bae
(74) *Attorney, Agent, or Firm* — Marshall A. Lerner; Marvin H. Kleinberg; Kleinberg & Lerner, LLP

(57) ABSTRACT

A radiating fin with a bent radiating portion and an electrothermal oil heater using the same are provided. The radiating fin comprises a main body with an oil guide groove formed therein, connecting sleeves extending in a horizontal direction being provided at an upper end and a lower end of the main body; a bent radiating portion is formed within a region, a certain distance away from the middle, of an edge of at least one end of the main body; and an upper end and a lower end of the bent radiating portion are located in different vertical planes, or the upper end and the lower end of the bent radiating portion are located in a same vertical plane, and at least one portion between the upper end and the lower end is bent to form a side-raised structure. Compared with the prior art, the radiating fin with a bent radiating portion provided in the present invention has the following advantages: by forming a bent radiating portion within a region, a certain distance from the middle, of an edge of any end of the radiating fin, when a plurality of the radiating fins are connected to each other, a combined radial and convective radiating way can be realized and meanwhile the transverse radiation and the longitudinal radiation of the radiator are strengthened.

13 Claims, 9 Drawing Sheets

(51) Int. Cl.

| | |
|---|---|
| ***F28F 3/08*** | (2006.01) |
| ***F28D 1/03*** | (2006.01) |
| ***F28D 1/053*** | (2006.01) |
| ***F28F 3/04*** | (2006.01) |
| ***F28F 3/12*** | (2006.01) |
| *F24D 19/00* | (2006.01) |
| *F28D 1/02* | (2006.01) |
| *F24D 13/04* | (2006.01) |
| *F28D 21/00* | (2006.01) |

(52) U.S. Cl.
CPC ..... *F28D 1/05358* (2013.01); *F28F 3/048* (2013.01); *F28F 3/083* (2013.01); *F28F 3/12* (2013.01); *F24D 13/04* (2013.01); *F24D 19/008* (2013.01); *F28D 1/0226* (2013.01); *F28D 2021/0035* (2013.01)

(56) References Cited

U.S. PATENT DOCUMENTS 4,336,444 A * 6/1982 Bice ..... F24H 1/225 165/104.19
4,369,838 A * 1/1983 Asanuma ..... H01L 23/4006 165/185
4,494,288 A * 1/1985 Nagai ..... B21D 53/085 29/890.047
5,390,731 A * 2/1995 Selm ..... F28F 1/128 165/152
8,327,634 B2 * 12/2012 Orihashi ..... F01N 3/055 165/51
9,448,012 B2 * 9/2016 Chen ..... F28F 1/40
D785,149 S * 4/2017 De'Longhi ..... D23/330
2001/0040025 A1 * 11/2001 Jurisich ..... F28D 1/0246 165/148
2002/0046826 A1 * 4/2002 Kao ..... F28D 15/00 165/104.33
2002/0079092 A1 * 6/2002 Shembekar ..... F28F 1/126 165/152
2005/0252639 A1 * 11/2005 Lin ..... H01L 23/3672 165/80.3
2007/0041767 A1 * 2/2007 Sawai ..... B41J 2/32 400/120.16
2007/0065123 A1 * 3/2007 Yao ..... F24H 3/004 392/375
2010/0027980 A1 * 2/2010 Yao ..... F24H 3/004 392/377
2012/0080177 A1 * 4/2012 Lee ..... F28D 15/0233 165/185
2013/0240185 A1 * 9/2013 Katoh ..... F28D 1/0426 165/140

* cited by examiner

RADIATING FIN WITH BENT RADIATING PORTION AND ELECTROTHERMAL OIL HEATER USING SAME

TECHNICAL FIELD

The present invention relates to a radiating fin, in particular to a radiating fin with a bent radiating portion, and the present invention further relates to an electrothermal oil heater using the same.

BACKGROUND ART

Oil-filled electrothermal warmers are referred to as electrothermal oil heaters now. The electrothermal oil heaters, as environmentally friendly, noiseless and other advantages, have been widely used in the world. There are 40 million electrothermal oil heaters manufactured every year. Such an electrothermal oil heater is generally assembled by a plurality of radiating fins, with gaps formed between the radiating fins, connected to each other via hollow connecting sleeves at an upper end and a lower end of the radiating fins. There is a cavity, filled with heat transfer oil, formed on each of the radiating fins. An electrical heating assembly is immersed in the heat transfer oil, and energy is transferred by heating the heat transfer oil. However, such a radiating fin has a limited radiating area and small heat supply range, and hence, the heat diversion effect is not very ideal. Merely increasing the superficial area of the radiating fin will increase energy consumption and expand space occupation, and also will degrade the mechanical strength of the radiating fin.

In China Utility Model Patent CN 200920141585.3, publicized on Jan. 20, 2010, a radiating fin for a warmer is disclosed, including a radiating fin, with a hollow connecting sleeve being respectively provided on an upper portion and a lower portion of the radiating fin, characterized in that both sides of the radiating fin are flanged symmetrically. In this technical solution, both sides of the radiating fin are flanged symmetrically, so that the radiating area of the radiating fin can be increased without increasing the space occupation thereof. Furthermore, the design of flanging enables formation of a chimney radiating channel between two adjacent radiating fins, thus to improve the radiating efficiency of the radiating fin. However, for an electrothermal oil heater in this solution, hot air will be mostly dispersed above the oil heater, and as a result, the heat radiating radius around sides of the oil heater will be significantly reduced. When there is an airer or something else placed above the oil heater, the convection of the radiating channel will be greatly impeded, and the radiating efficiency of the oil heater will be influenced. Consequently, the temperature interior of the oil heater is too high and the service life of the oil heater will be shortened.

SUMMARY OF THE INVENTION

A technical problem to be solved by the present invention is to provide a radiating fin with a bent radiating portion, in order to overcome the aforementioned deficiencies in the prior art. Such a radiating fin allows for large radiating area and high mechanical strength, and a combined radial and convective radiating way may be realized when a plurality of the radiating fins are connected to each other to form a radiator.

A technical problem to be solved by the present invention is to provide an electrothermal oil heater, in order to overcome the aforementioned deficiencies in the prior art. In such an electrothermal oil heater, a bent radiating portion is formed on the radiating fin, and a combined radial and convective radiating way may be thus realized.

The radiating fin with a bent radiating portion provided by the present invention employs the following main technical solution. The radiating fin includes a main body with an oil guide groove formed therein, connecting sleeves extending in a horizontal direction being provided at an upper end and a lower end of the main body; a bent radiating portion is formed within a region, a certain distance away from the middle, of an edge of at least one end of the main body; an upper end and a lower end of the bent radiating portion are located in different vertical planes, or the upper end and the lower end of the bent radiating portion are located in a same vertical plane, and at least one portion between the upper end and the lower end is bent to form a side-raised structure; and the area of the bent radiating portion is 10% to 80% of the total area of the main body.

The radiating fin with a bent radiating portion provided by the present invention further employs the following dependent technical solution.

The upper end and the lower end of the bent radiating portion are located in different vertical planes and connected to each other by a twisted portion, the twisted portion including two bending portions in opposite directions.

An included angle between a plane of the upper end and a plane of the lower end is 5° to 85°.

The upper end and the lower end of the bent radiating portion are located in a same vertical plane and connected to each other by a bent portion, the bent portion including two bending portions in a same direction.

An included angle between a vertical projection of the upper end and the lower end and a vertical projection of the bent portion is 5° to 85°.

A distance from an apex of the bent portion to the plane of the upper end and the lower end is 5 mm to 70 mm.

The upper end and the lower end of the bent radiating portion are located in a same vertical plane and connected to each other by a plurality of bent portions, the bent portions each including two bending portions in a same direction.

Two adjacent bent portions are bent in opposite directions.

An included angle between a vertical projection of the upper end and the lower end and a vertical projection of the bent portion is 5° to 85°.

A distance from an apex of the bent portion to the plane of the upper end and the lower end is 5 mm to 70 mm.

An annular enclosed portion is provided in the middle of the main body; the annular enclosed portion divides the main body into a radiating portion located on the outer side of the annular enclosed portion and an oil guide portion located on the inner side of the annular enclosed portion; and the radiating portion, on at least one end of the main body, is the bent radiating portion.

The main body includes a big radiating fin and a small radiating fin welded on the big radiating fin; the big radiating portion has the annular enclosed portion arranged in the middle, and the periphery of the small radiating portion is welded to the annular enclosed portion; and a portion, on the outer side of the annular enclosed portion, of the big radiating portion is the radiating portion.

Curved traces, formed by longitudinal cross-sections of any parts of the bent radiating portion in the horizontal direction, do not overlap with each other.

The bent radiating portion is formed by punching and stretching.

The electrothermal oil heater provided by the present invention employs the following main technical solution. The electrothermal oil heater includes a radiator, a heating assembly mounted in the radiator, and an electrically-controlled assembly provided on the radiator, the radiator including a plurality of radiating fins with a bent radiating portion, the plurality of radiating fins being connected to each other successively. The radiating fin with a bent radiating portion includes a main body with an oil guide groove formed therein, connecting sleeves extending in a horizontal direction being provided at an upper end and a lower end of the main body, a bent radiating portion is formed within a region, a certain distance away from the middle, of an edge of at least one end of the main body; an upper end and a lower end of the bent radiating portion are located in different vertical planes, or the upper end and the lower end of the bent radiating portion are located in a same vertical plane, and at least one portion between the upper end and the lower end is bent to form a side-raised structure.

Compared with the prior art, the radiating fin with a bent radiating portion provided by the present invention has the following advantages: by forming a bent radiating portion within a region, a certain distance away from the middle, of an edge of any end of the radiating fin, the radiating area of the radiating fin is increased and the mechanical strength of the radiating fin is strengthened; and when a plurality of the radiating fins are connected to each other, a combined radial and convective radiating way may be realized and meanwhile the transverse radiation and the longitudinal radiation of the radiator are strengthened, so that a user may feel the heat more directly. Such a structure may further prevent the surface temperature of the radiator from being too high, the heat radiation of the radiator to the surrounding is more uniform, and the radiating efficiency of the radiator is improved.

Compared with the prior art, the electrothermal oil heater provided by the present invention has the following advantages: the radiating fin with a bent radiating portion herein may realize a combined radial and convective radiating way, and meanwhile strengthen the transverse radiation and the longitudinal radiation of the radiator, so that a user may feel the heat more directly. Such a structure may further prevent the surface temperature of the radiator from being too high, the heat radiation of the radiator to the surrounding is more uniform, and the radiating efficiency of the radiator is improved.

THE DESCRIPTION OF DRAWINGS

SPECIFIC EMBODIMENTS

Embodiment 1

Figure 1:
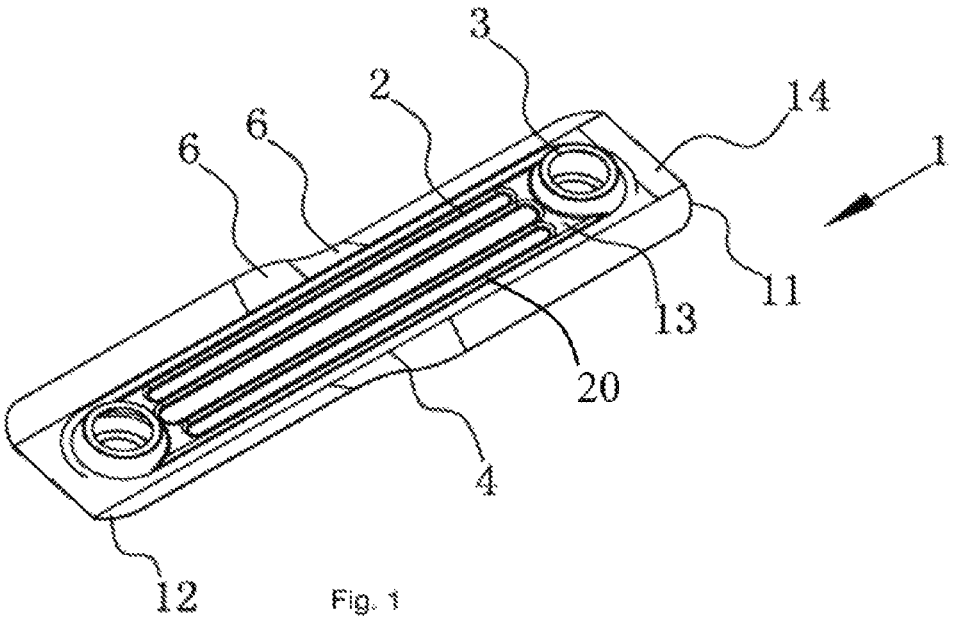
FIG. 1 is a structural diagram of the radiating fin according to Embodiment 1 of the present invention.
Figure 2:
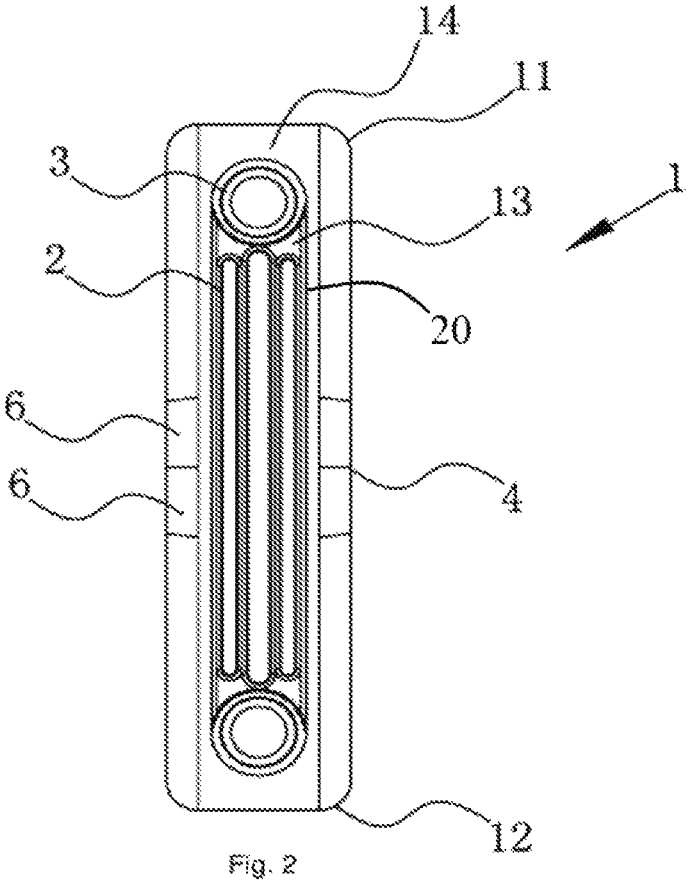
FIG. 2 is a front view of the radiating fin according to Embodiment 1 of the present invention.
Figure 3:
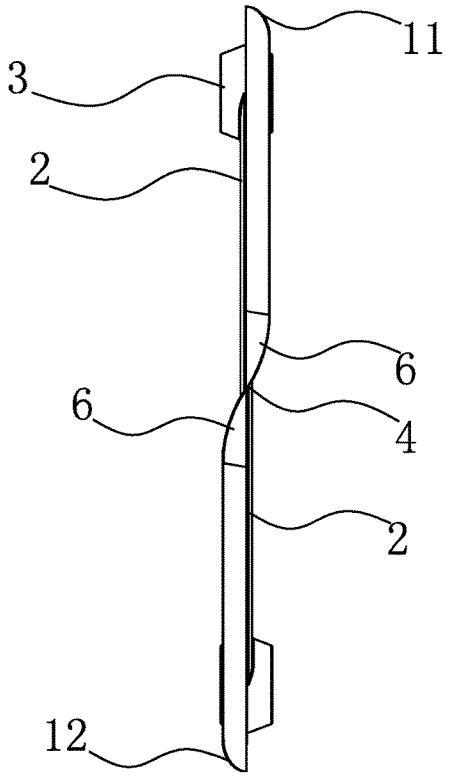
FIG. 3 is a side view of the radiating fin according to Embodiment 1 of the present invention.
Figure 4:
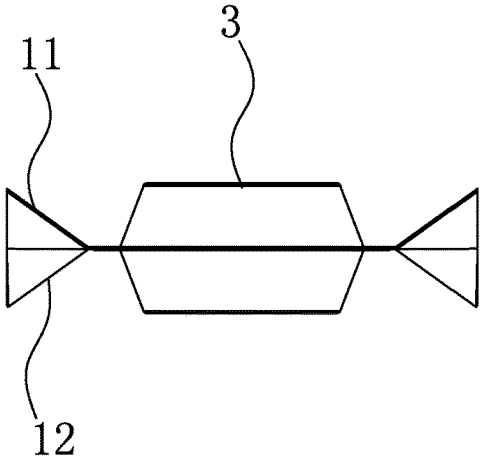
FIG. 4 is a top view of the radiating fin according to Embodiment 1 of the present invention.
Figure 5:
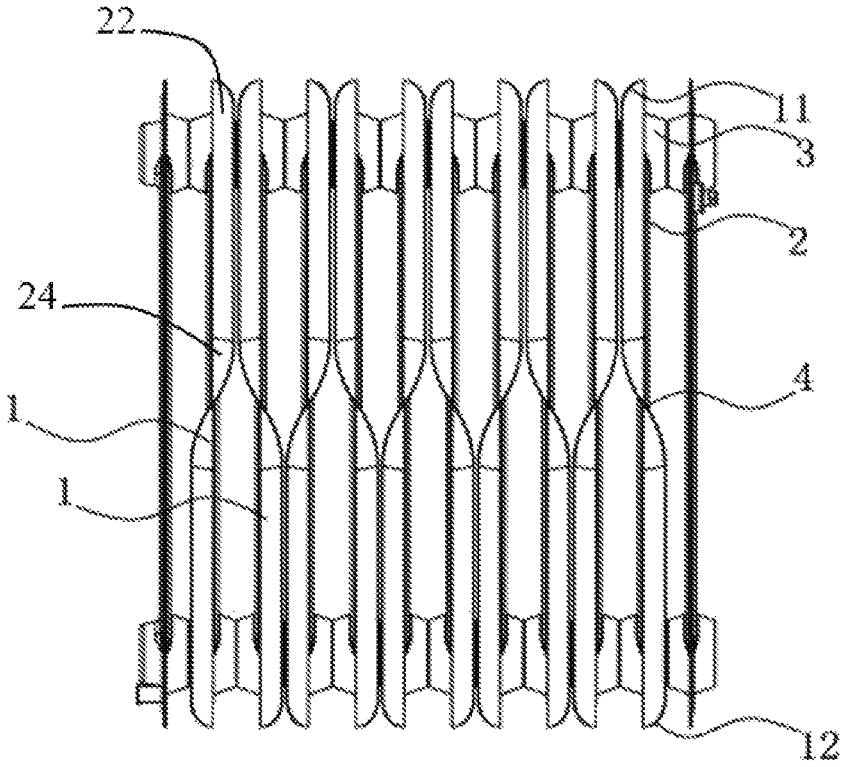
FIG. 5 is a structural diagram of the radiator according to Embodiment 1 of the present invention, when assembled.
Figure 6:
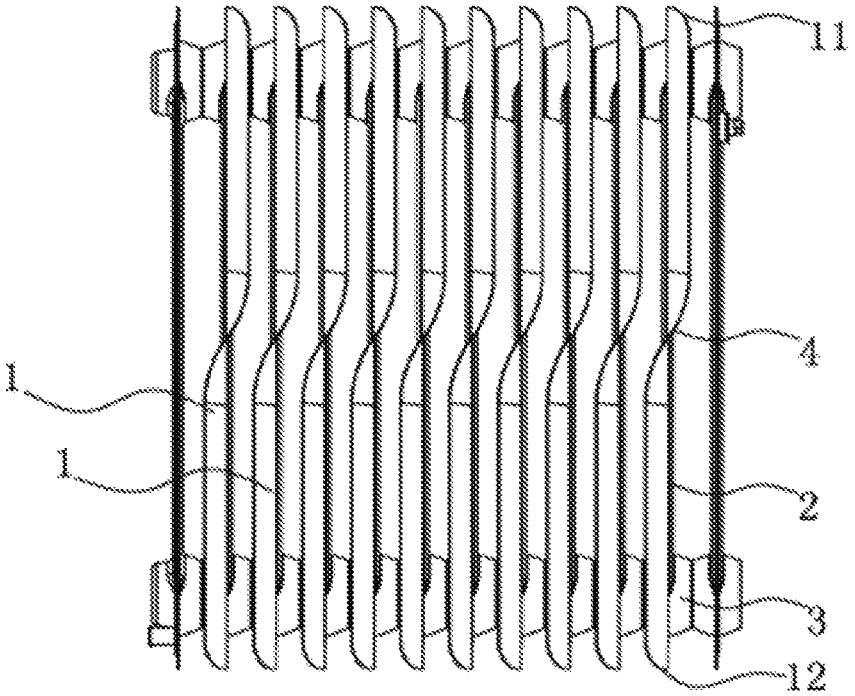
FIG. 6 is a structural diagram of the radiator according to Embodiment 1 of the present invention, when assembled in another manner.

Referring to FIG. 1 to FIG. 6, according to this embodiment of the radiating fin with a bent radiating portion provided by the present invention, the radiating fin includes a main body 1 with an oil guide groove 2 formed therein, connecting sleeves 3 extending in a horizontal direction are provided at an upper end 11 and a lower end 12 of the main body 1; a bent radiating portion is formed within a region, a certain distance away from the middle, of an edge of at least one end of the main body 1; and an upper end 11 and a lower end 12 of the bent radiating portion are located in different vertical planes and connected to each other by a twist portion 4, the twist portion 4 including two bending portions 6 in opposite directions. By forming a bent radiating portion within a region, a certain distance away from the middle, of an edge of any end of the radiating fin, the radiating area of the radiating fin is increased and the mechanical strength of the radiating fin is strengthened; and when a plurality of the radiating fins are connected to each other, a combined radial and convective radiating way may be realized, and meanwhile the transverse radiation and the longitudinal radiation of the radiator are strengthened, so that a user may feel the heat more directly. Such a structure may further prevent the surface temperature of the radiator from being too high, the heat radiation of the radiator to the surrounding is more uniform, and the radiating efficiency of the radiator is improved, so that the heat radiation around and above the radiator may be balanced during the operation of the electrothermal oil heater.

The area of the bent radiating portion is 10% to 80% of the total area of the main body, and preferably 40% in this embodiment. The bent radiating portion within this range may balance the transverse radiation and the longitudinal radiation of the radiator and ensure the radiating efficiency.

An included angle between a plane of the upper end and a plane of the lower end is 5° to 85°, and preferably 36° in this embodiment. This angle may ensure the convection at the upper ends or lower ends of two adjacent radiating fins, without damaging the twist portion. Terms "upper end 11" and "lower end 12" are not provided for defining the upper end 11 and the lower end 12 of the main body 1 and instead, for defining the position relation thereof, hence, a left end and a right end are also possible. The upper end 11 and the lower end 12 of the main body 1 are defined as being located in different vertical planes, when the bent radiating portion is located at the left end and right end of the main body 1; and the left end 11 and the right end 12 of the main body 1 are defined as being located in different vertical planes, when the bent radiating portion is located at the upper end and the lower end.

Referring to FIG. 1 to FIG. 6, according to this embodiment of the present invention, an annular enclosed portion 20 is provided in the middle of the main body 1; the annular enclosed portion 20 divides the main body 1 into a radiating portion 14 located on the outer side of the annular enclosed portion 20 and an oil guide portion 13 located on the inner side of the annular enclosed portion 20; and the radiating portion 14, on at least one end of the main body 1, is the bent radiating portion. Such a structure, in which radiating portion 14, on at least one end of the main body 1, is the bent radiating portion, may effectively prevent the deformation of the oil guide portion 13 upon forming the bent radiating portion, avoid the deformation of the oil guide groove 2 or connecting sleeve 3, and prevent a welding point from being burst. It would be helpful to improve the qualified rate and the assembly efficiency of the products.

According to this embodiment of the present invention, the main body 1 includes a big radiating fin 22 and a small radiating fin 24 welded on the big radiating fin 22; the big radiating portion has the annular enclosed portion 20 arranged in the middle, and the periphery of the small radiating portion is welded to the annular enclosed portion 20; and a portion, on the outer side of the annular enclosed portion 20, of the big radiating portion is the radiating portion. The radiating fin of the present invention is easy in structure, convenient in assembly and low in cost; and the radiating portion is of a monolayer structure, which is convenient to form the bent radiating portion by punching and stretching.

According to this embodiment of the present invention, the annular enclosed portion 20 is a welding portion on the big radiating portion and the small radiating portion. The annular enclosed portion 20 is convenient to machine and firm in connection, and has excellent sealing effect and low production cost.

Referring to FIG. 1 to FIG. 6, according to this embodiment, curved traces, formed by longitudinal cross-sections of any part of the bent radiating portion in the horizontal direction, do not overlap with each other. The bent radiating portion with this structure is convenient to be formed, and is prevented from being damaged when it is stretched to the maximum extent.

Referring to FIG. 1 to FIG. 6, according to this embodiment, the bent radiating portion is formed by punching and stretching. The bent radiating portion is convenient to machine and low in production cost.

Referring to FIG. 1 to FIG. 6, according to this embodiment of the electrothermal oil heater provided by the present invention, the electrothermal oil heater includes a radiator, a heating assembly mounted in the radiator, and an electrically-controlled assembly provided on the radiator, the radiator including a plurality of oil heater radiating fins, the plurality of oil heater radiating fins being connected to each other successively. Both the heating assembly and the electrically-controlled assembly are mature technologies in the prior art, and thus will not be repeated here. The oil heater radiating fin described in this embodiment is the radiating fin with a bent radiating portion as described in the aforementioned embodiment. The radiating fin with a bent radiating portion in the present invention may realize a combined radial and convective radiating way, and meanwhile strengthen the transverse radiation and the longitudinal radiation of the radiator, so that a user may feel the heat more directly. Such a structure may further prevent the surface temperature of the radiator from being too high, the heat radiation of the radiator to the surrounding is more uniform, and the radiating efficiency of the radiator is improved. The radiating fin in the present invention is connected in two ways. One is that, a plurality of radiating fins are connected to each other successively, with the back of one of two adjacent radiating fins being opposite to the front of the other; and the other way is that, a plurality of radiating fins are connected to each other successively, with the back of one of two adjacent radiating fins being opposite to the back of the other, or the front of one of two adjacent radiating fins being opposite to the front of the other.

Embodiment 2

Figure 7:
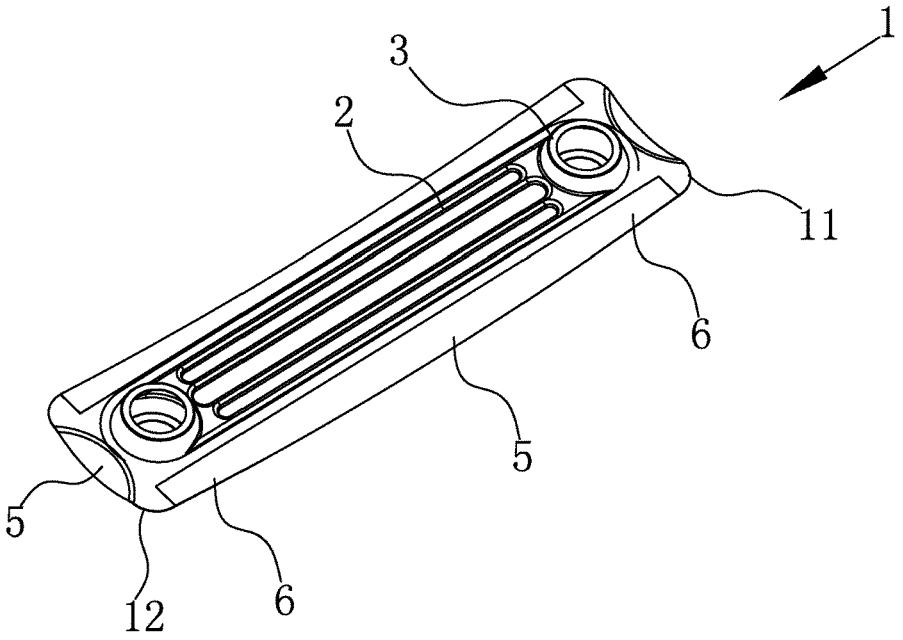
FIG. 7 is a structural diagram of the radiating fin according to Embodiment 2 of the present invention.
Figure 8:
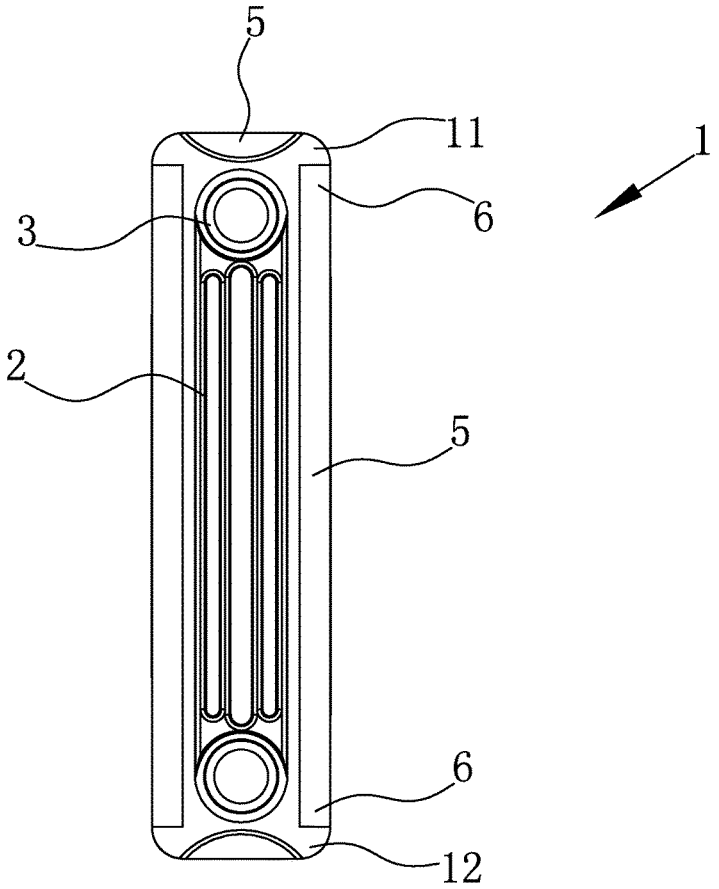
FIG. 8 is a front view of the radiating fin according to Embodiment 2 of the present invention.
Figure 9:
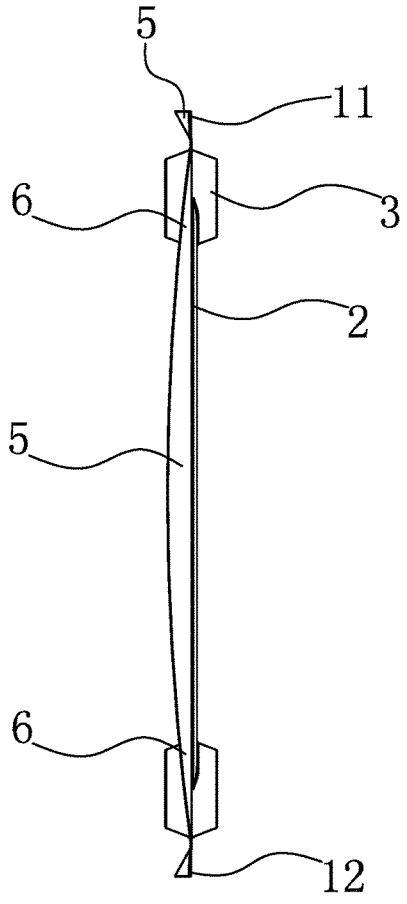
FIG. 9 is a side view of the radiating fin according to Embodiment 2 of the present invention.
Figure 10:
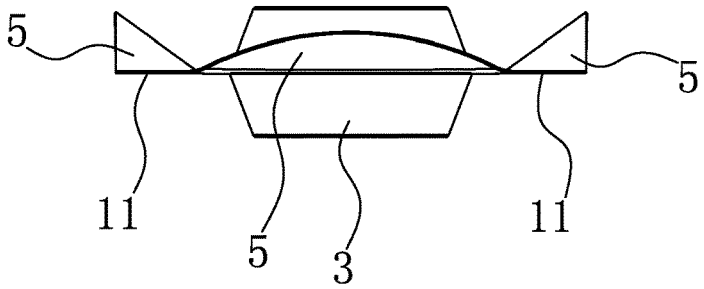
FIG. 10 is a top view of the radiating fin according to Embodiment 2 of the present invention.
Figure 11:
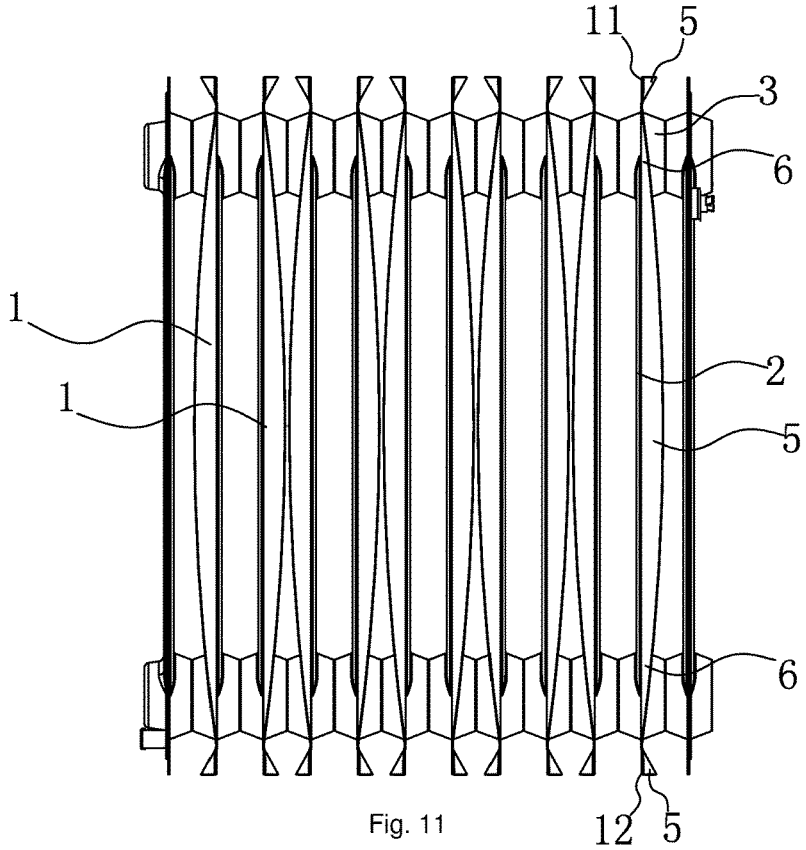
FIG. 11 is a structural diagram of the radiator according to Embodiment 2 of the present invention, when assembled.
Figure 12:
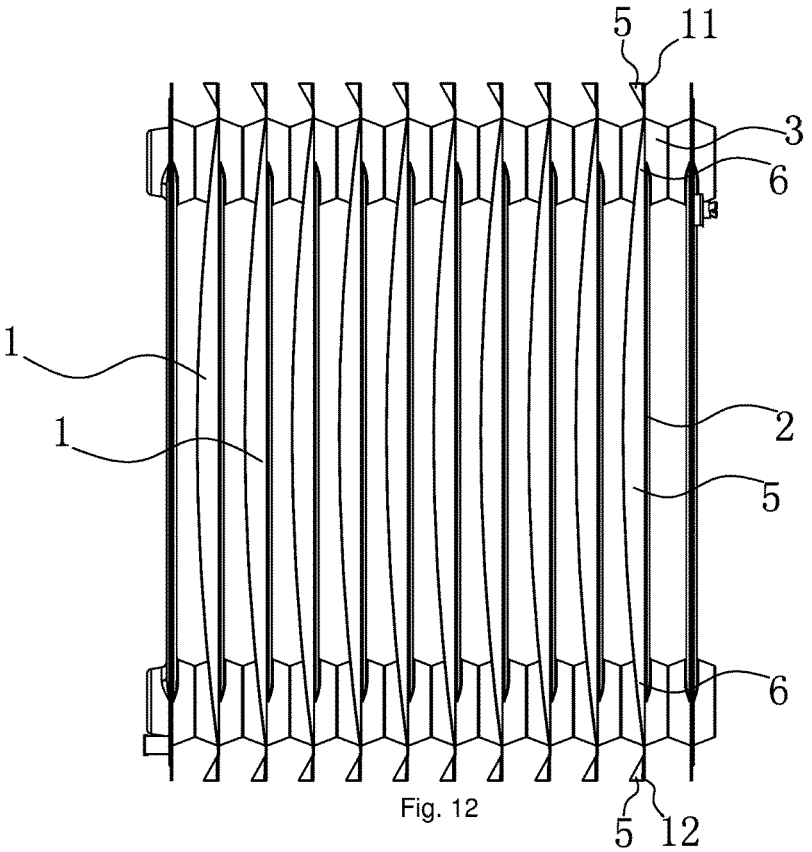
FIG. 12 is a structural diagram of the radiating fin according to Embodiment 2 of the present invention, when assembled in another manner.

Referring to FIG. 7 to FIG. 12, this embodiment is roughly the same as the aforementioned embodiment 1, with the difference in that the upper end 11 and the lower end 12 of the bent radiating portion in this embodiment are located in a same vertical plane and connected to each other by a bent portion 5, the bent portion 5 including two bending portions 6 in a same direction. An included angle between a vertical projection of the upper end and the lower end and a vertical projection of the bent portion is 5° to 85°, and preferably 36° in this embodiment. This angle may ensure the convection of upper ends and the lower ends of two adjacent radiating fins, without damaging the twisted portion. A distance from an apex of the bent portion 5 to the plane of the upper end and the lower end is 5 mm to 70 mm, and preferably 20 mm in this embodiment. By forming a bent radiating portion within a region, a certain distance away from the middle, of an edge of any end of the radiating fin, the radiating area of the radiating fin is increased and the mechanical strength of the radiating fin is strengthened; and when a plurality of the radiating fins are connected to each other, a combined radial and convective radiating way may be realized and meanwhile the transverse radiation and the longitudinal radiation of the radiator are strengthened, so that a user may feel the heat more directly. Such a structure may further prevent the surface temperature of the radiator from being too high, the heat radiation of the radiator to the surrounding is more uniform, and the radiating efficiency of the radiator is improved.

Embodiment 3

Figure 13:
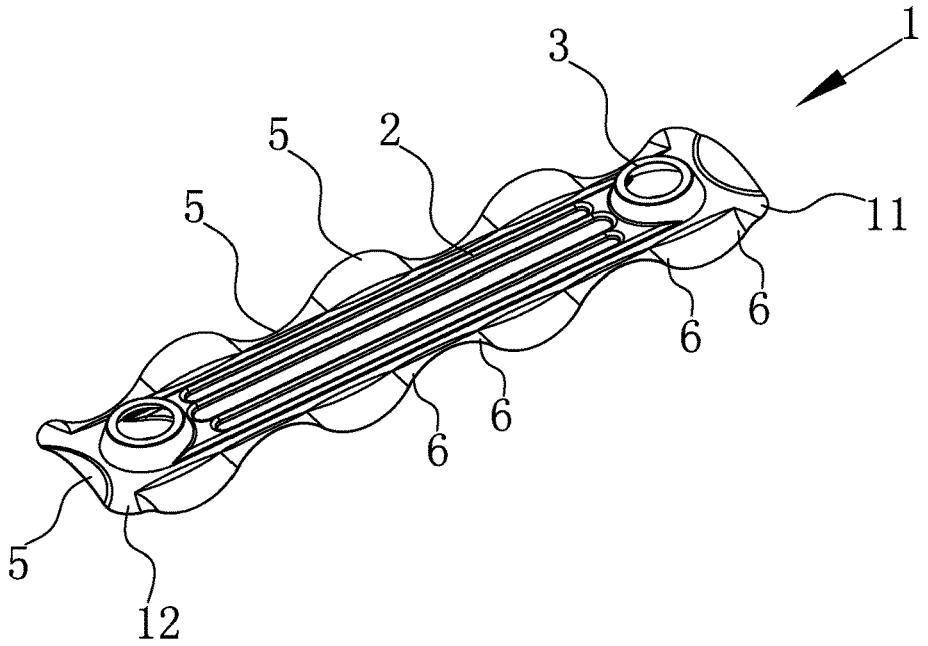
FIG. 13 is a structural diagram of the radiating fin according to Embodiment 3 of the present invention.
Figure 14:
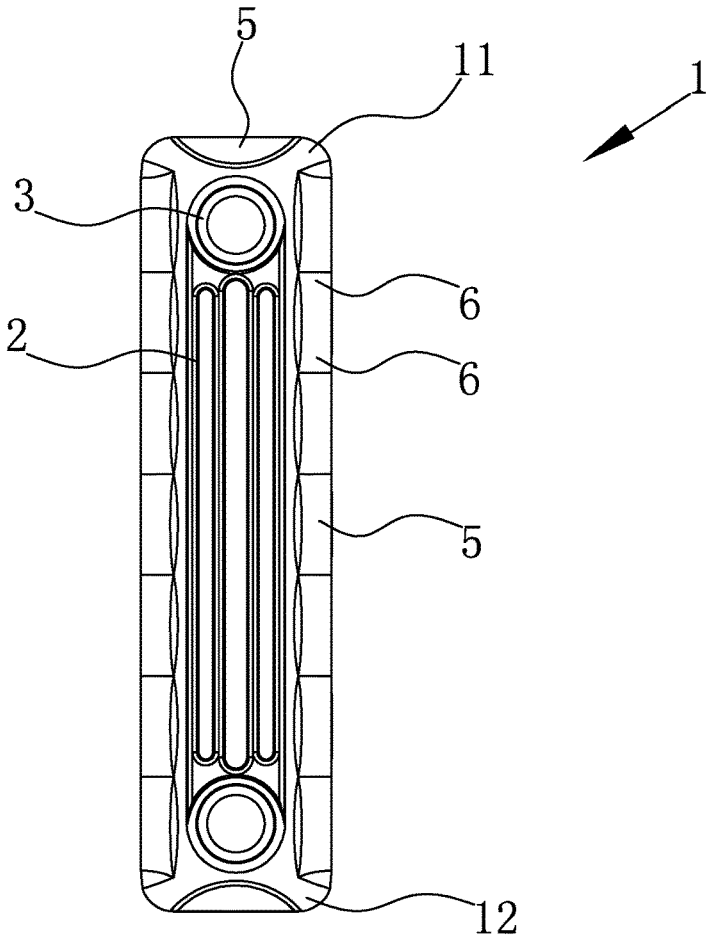
FIG. 14 is a front view of the radiating fin according to Embodiment 3 of the present invention.
Figure 15:
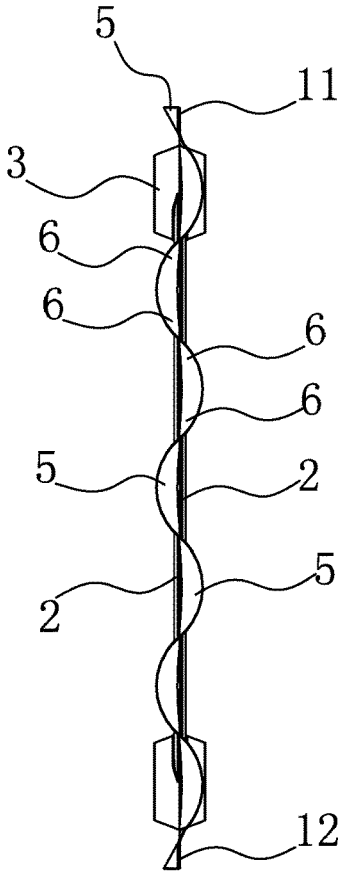
FIG. 15 is a side view of the radiating fin according to Embodiment 3 of the present invention.
Figure 16:
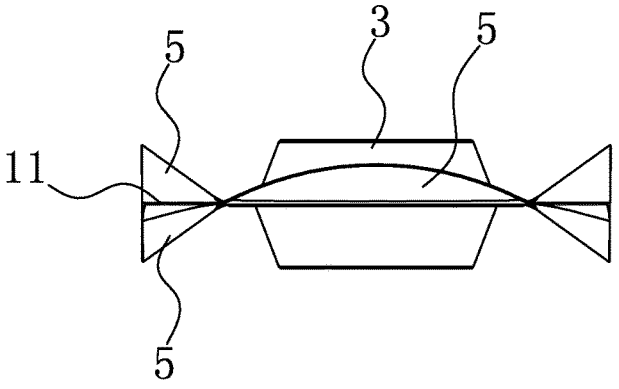
FIG. 16 is a top view of the radiating fin according to Embodiment 3 of the present invention.
Figure 17:
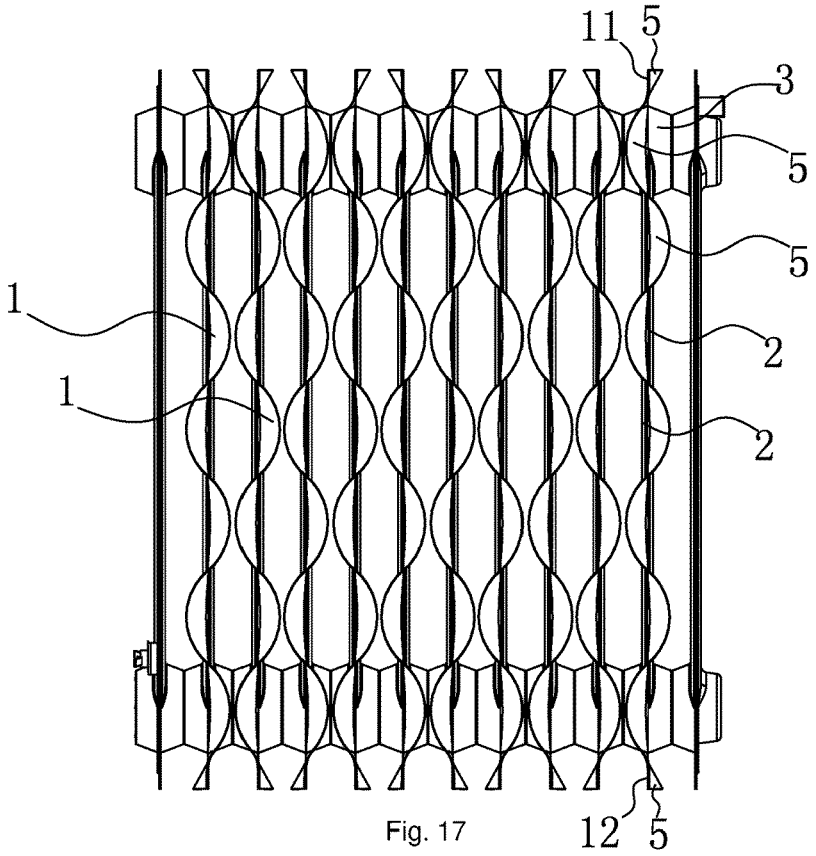
FIG. 17 is a structural diagram of the radiator according to Embodiment 3 of the present invention, when assembled.
Figure 18:
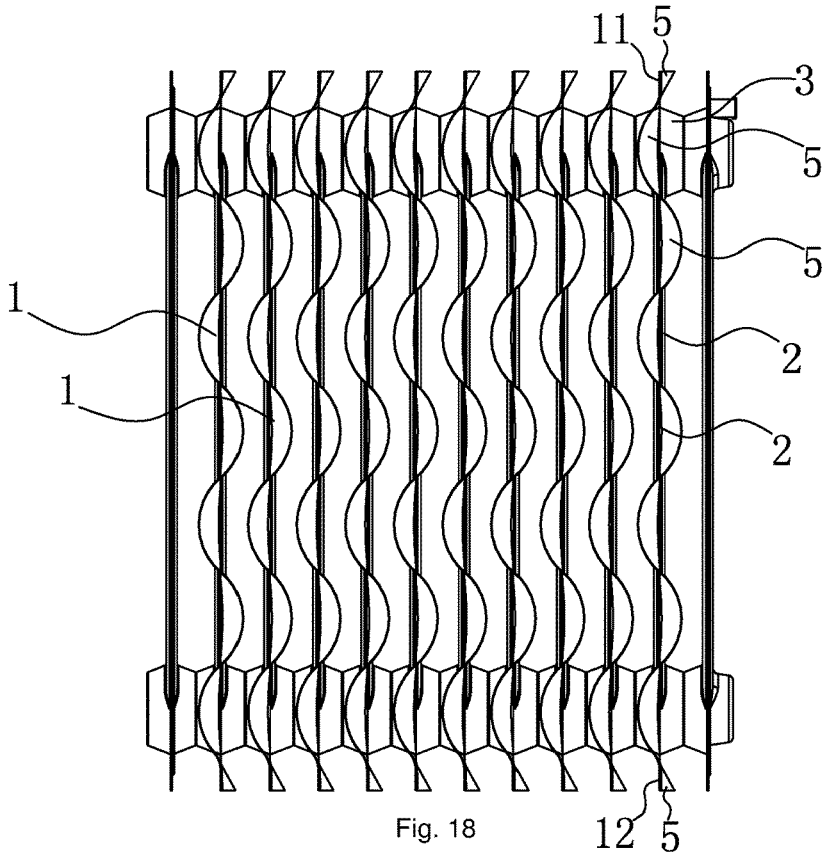
FIG. 18 is a structural diagram of the radiator according to Embodiment 3 of the present invention, when assembled in another manner.

Referring to FIG. 13 to FIG. 18, this embodiment is roughly the same as the aforementioned embodiment 1, with the difference in that the upper end 11 and the lower end 12 of the bent radiating portion in this embodiment are located in a same vertical plane and connected to each other by a plurality of bent portions 5, two adjacent bent portions 5 are bent in opposite directions, and each of the bent portions 5 includes two bending portions 6 in a same direction. An included angle between a vertical projection of the upper end and the lower end and a vertical projection of the bent portion is 5° to 85°, and preferably 36° in this embodiment. This angle may ensure the convection of upper ends and the lower ends of two adjacent radiating fins, without damaging the twisted portion. A distance from an apex of the bent portion to the plane of the upper end and the lower end is 5 mm to 70 mm, and preferably 20 mm in this embodiment. By forming a bent radiating portion within a region, a certain distance away from the middle, of an edge of any end of the radiating fin, the radiating area of the radiating fin is increased and the mechanical strength of the radiating fin is strengthened; and when a plurality of the radiating fins are connected to each other, a combined radial and convective radiating way may be realized, and meanwhile the transverse radiation and the longitudinal radiation of the radiator are strengthened, so that a user may feel the heat more directly. Such a structure may further prevent the surface temperature of the radiator from being too high, the heat radiation of the radiator to the surrounding is more uniform, and the radiating efficiency of the radiator is improved.

Although the embodiments of the present invention have been shown and described above, it should be understood that a person of ordinary skill in the art may change those embodiments without departing from the principle and spirit of the present invention, and the scope of the present invention is defined by the attached claims and equivalents thereof.

The invention claimed is:

1. A radiating fin with a bent radiating portion, comprising a heating assembly and a main body with an oil guide groove formed therein, connecting sleeves extending in a horizontal direction being provided at an upper end and a lower end of the main body, characterized in that the bent radiating portion is formed within a region, a certain distance away from the middle, of an edge of at least one end of the main body; an upper end and a lower end of the bent radiating portion are located in different vertical planes, or the upper end and the lower end of the bent radiating portion are located in a same vertical plane, and at least one portion between the upper end and the lower end of the bent radiating portion is bent to form a side-raised structure wherein an included angle between a plane of the upper end and a plane of the lower end is 5° to 85° in the included angle of the plane of the upper end of one of the connecting sleeves and the included angle of the plane of the upper end of another one of the connecting sleeves enabling formation of a chimney radiation channel with a space between two adjacent radiating fins and making the radiating area of the radiating fin increased and the mechanical strength of the radiating fin strengthened and making the heat radiation of a radiator to the surrounding more uniform and the radiating efficiency of the radiator improved, and the area of the bent radiating portion is 10% to 80% of the total area of the main body is characterized in that the upper end having the one of the connecting sleeves and the lower end of the bent radiating portion having the another one of the connecting sleeves are located in a same vertical plane and connected to each other by a plurality of bent portions, the bent portions each comprising two bending portions in a same direction.

2. The radiating fin with a bent radiating portion according to claim 1, characterized in that the upper end and the lower end of the bent radiating portion are located in different vertical planes and connected to each other by a twisted portion, and the twisted portion comprises two bending portions in opposite directions.

3. The radiating fin with a bent radiating portion according to claim 2, characterized in that an included angle between a plane of the upper end and a plane of the lower end is 40° to 85°.

4. The radiating fin with a bent radiating portion according to claim 1, characterized in that the upper end and the lower end of the bent radiating portion are located in a same vertical plane and connected to each other by a bent portion, the bent portion comprising two bending portions in a same direction.

5. The radiating fin with a bent radiating portion according to claim 4, characterized in that an included angle between a vertical projection of the upper end and the lower end and a vertical projection of the bent radiating portion is 40° to 85°.

6. The radiating fin with a bent radiating portion according to claim 4, characterized in that a distance from an apex of the bent radiating portion to the plane of the upper end and the lower end is 5 mm to 70 mm.

7. The radiating fin with a bent radiating portion according to claim 1, characterized in that two adjacent bending portions are bent in opposite directions.

8. The radiating fin with a bent radiating portion according to claim 1, characterized in that an included angle between a vertical projection of the upper end and the lower end and a vertical projection of each bent portion is 40° to 85°.

9. The radiating fin with a bent radiating portion according to claim 1, characterized in that a distance from an apex of each bent portion to the plane of the upper end and the lower end is 5 mm to 70 mm.

10. The radiating fin with a bent radiating portion according to any one of claim 1-6 or 7-9, characterized in that an annular enclosed portion is provided in the middle of the main body; the annular enclosed portion divides the main body into a radiating portion located on the outer side of the annular enclosed portion and an oil guide portion located on the inner side of the annular enclosed portion; and the radiating portion, on at least one end of the main body, is the bent radiating portion.

11. The radiating fin with a bent radiating portion according to claim 10, characterized in that the main body comprises a big radiating fin and a small radiating fin welded on the big radiating fin; the big radiating fin has the annular enclosed portion arranged in the middle, and the periphery of the small radiating fin is welded to the annular enclosed portion; and a portion, on the outer side of the annular enclosed portion, of the big radiating portion is the radiating portion.

12. The radiating fin with a bent radiating portion according to any one of claim 1-6 or 7-9, characterized in that curved traces, formed by longitudinal cross-sections of any parts of the bent radiating portion in the horizontal direction, do not overlap with each other.

13. The radiating fin with a bent radiating portion according to any one of claim 1-6 or 7-9, characterized in that the bent radiating portion is formed by punching and stretching.

* * * * *